US010648674B1

(12) United States Patent
Boyd

(10) Patent No.: US 10,648,674 B1
(45) Date of Patent: May 12, 2020

(54) HEAT PUMP SYSTEM, COMPONENTS THEREOF AND METHODS OF USING THE SAME

(71) Applicant: John Edward Boyd, Old Greenwich, CT (US)

(72) Inventor: John Edward Boyd, Old Greenwich, CT (US)

( * ) Notice: Subject to any disclaimer, the term of this patent is extended or adjusted under 35 U.S.C. 154(b) by 1999 days.

(21) Appl. No.: 13/732,388

(22) Filed: Jan. 1, 2013

Related U.S. Application Data

(60) Provisional application No. 61/585,095, filed on Jan. 10, 2012.

(51) Int. Cl.
*F24B 1/183* (2006.01)
*F24D 11/00* (2006.01)
*F24H 1/06* (2006.01)

(52) U.S. Cl.
CPC ..... *F24B 1/183* (2013.01); *F24D 11/002* (2013.01); *F24H 1/06* (2013.01)

(58) Field of Classification Search
CPC ..... F24H 3/00; F24H 3/008; F24H 3/0494; F24H 7/00; F24H 7/007
USPC ..... 237/7, 56
See application file for complete search history.

(56) References Cited

U.S. PATENT DOCUMENTS 2,232,342 A * 2/1941 Prosser ..... 237/17
3,240,261 A * 3/1966 Morales ..... 165/254
3,866,595 A * 2/1975 Jones ..... F24B 1/1888 126/521
3,880,141 A * 4/1975 Abshear ..... F24S 1/1885 126/521
3,945,369 A 3/1976 Adams et al. ..... 126/164
3,958,755 A 5/1976 Cleer ..... 237/8 R
4,019,677 A 4/1977 Dotschkal et al. ..... 236/9 A
4,049,194 A 9/1977 Tice et al. ..... 237/1 A
4,116,379 A 9/1978 Movick ..... 237/56
4,139,152 A 2/1979 Kronberger ..... 237/8 R
4,143,816 A 3/1979 Skadeland ..... 237/8 R
4,173,993 A * 11/1979 Skala ..... 165/48.1
4,178,908 A 12/1979 Trexler, Sr. ..... 126/121
4,180,053 A 12/1979 Patel ..... 126/120
4,187,834 A * 2/1980 Hoinski ..... 126/574
4,191,163 A 3/1980 Ballard ..... 126/132
4,228,784 A 10/1980 Malafouris ..... 126/522
4,230,267 A 10/1980 Dotschkal et al. ..... 236/9 A
4,258,879 A * 3/1981 Nischwitz ..... F24S 1/1886 122/128
4,258,880 A 3/1981 Williamson ..... 237/56
4,284,067 A * 8/1981 Kilar ..... F24D 11/007 126/620
4,330,083 A * 5/1982 Di Fiore ..... 237/56
(Continued)

FOREIGN PATENT DOCUMENTS

GB 2469494 * 10/2010

OTHER PUBLICATIONS

Mitre 10 MEGA—Heat Transfer Kits (downloaded from internet). www.sustainability.vic.gov.au_resources_documents_Heat_shifters BB.

*Primary Examiner* — Christopher R Harmon

(57) ABSTRACT

Heat transfer systems employing a heat transfer means (e.g., circulating fluid, thermally conductive material, etc.) to transfer heat from the heat source (e.g., fireplace, wood stove or other heat source) to a remote location of a home, residence, building or other structure.

27 Claims, 1 Drawing Sheet

(56) References Cited

U.S. PATENT DOCUMENTS 4,334,518 A 6/1982 Ort ..... 126/132
4,344,411 A * 8/1982 Dearborn ..... F24B 1/183 126/34
4,422,614 A * 12/1983 Santos ..... 248/475.1
4,425,901 A * 1/1984 Callison ..... F24S 7/00 126/220
4,446,848 A 5/1984 Becker et al. ..... 126/121
4,462,542 A 7/1984 Person ..... 237/19
4,466,420 A 8/1984 Eraisse et al. ..... 126/120
4,470,542 A 9/1984 Pierce et al. ..... 237/8 R
4,473,061 A 9/1984 Milano ..... 126/132
4,496,099 A * 1/1985 Bull ..... 237/7
4,629,117 A 12/1986 Kasbohm ..... 237/55
4,878,483 A * 11/1989 Todorski ..... F24B 7/025 126/523
4,979,494 A * 12/1990 Andersen ..... F24J 2/02 126/573
5,103,651 A * 4/1992 Coelho ..... A01N 1/02 220/592.1
5,330,104 A * 7/1994 Marcus ..... 239/266
5,706,798 A * 1/1998 Steinorth ..... 126/681
5,823,175 A * 10/1998 Sweitzer et al. ..... 126/34
5,901,730 A * 5/1999 Tisbo ..... B65H 75/403 137/15.01
5,979,782 A * 11/1999 Elwart ..... F24S 1/187 237/16
6,305,185 B1 * 10/2001 Sloan ..... A45C 5/14 62/235.1
6,328,220 B1 * 12/2001 Taylor ..... F24C 15/003 237/78 R
6,543,526 B2 4/2003 Jacobs ..... 165/144
6,866,036 B2 * 3/2005 Jacobs ..... F24D 17/001 126/299 D
6,908,039 B2 6/2005 Lyons et al. ..... 237/55
7,410,104 B2 * 8/2008 MacPherson ..... F24D 3/12 165/49
7,612,735 B2 * 11/2009 Essig, Jr. ..... A01K 61/007 343/709
7,730,676 B2 * 6/2010 Hon ..... 52/173.3
2001/0042610 A1 11/2001 Lyons et al. ..... 165/47
2005/0120715 A1 6/2005 Labrador ..... 60/618
2005/0199233 A1 9/2005 Butler et al. ..... 126/523
2005/0257787 A1 * 11/2005 Dolton, III ..... F24B 1/1888 126/522
2007/0051820 A1 3/2007 Loewen et al. ..... 236/49
2007/0227529 A1 * 10/2007 Rubio ..... F24D 17/0021 126/614
2008/0086884 A1 * 4/2008 Hultmark ..... B21D 53/08 29/890.038
2008/0156892 A1 7/2008 Eberhardt ..... 237/81
2008/0173260 A1 * 7/2008 Lange ..... 122/31.1
2008/0223945 A1 9/2008 Lau et al. ..... 237/50
2010/0186820 A1 * 7/2010 Schon ..... F24J 2/12 136/259
2010/0237156 A1 9/2010 Minogue ..... 237/59
2011/0201264 A1 8/2011 Hendrickson ..... 254/253
2011/0214659 A1 9/2011 Ogden ..... 126/58
2011/0271948 A1 11/2011 Redford ..... 126/67
2012/0176745 A1 * 7/2012 Helberg ..... G06F 1/1632 361/679.47

* cited by examiner

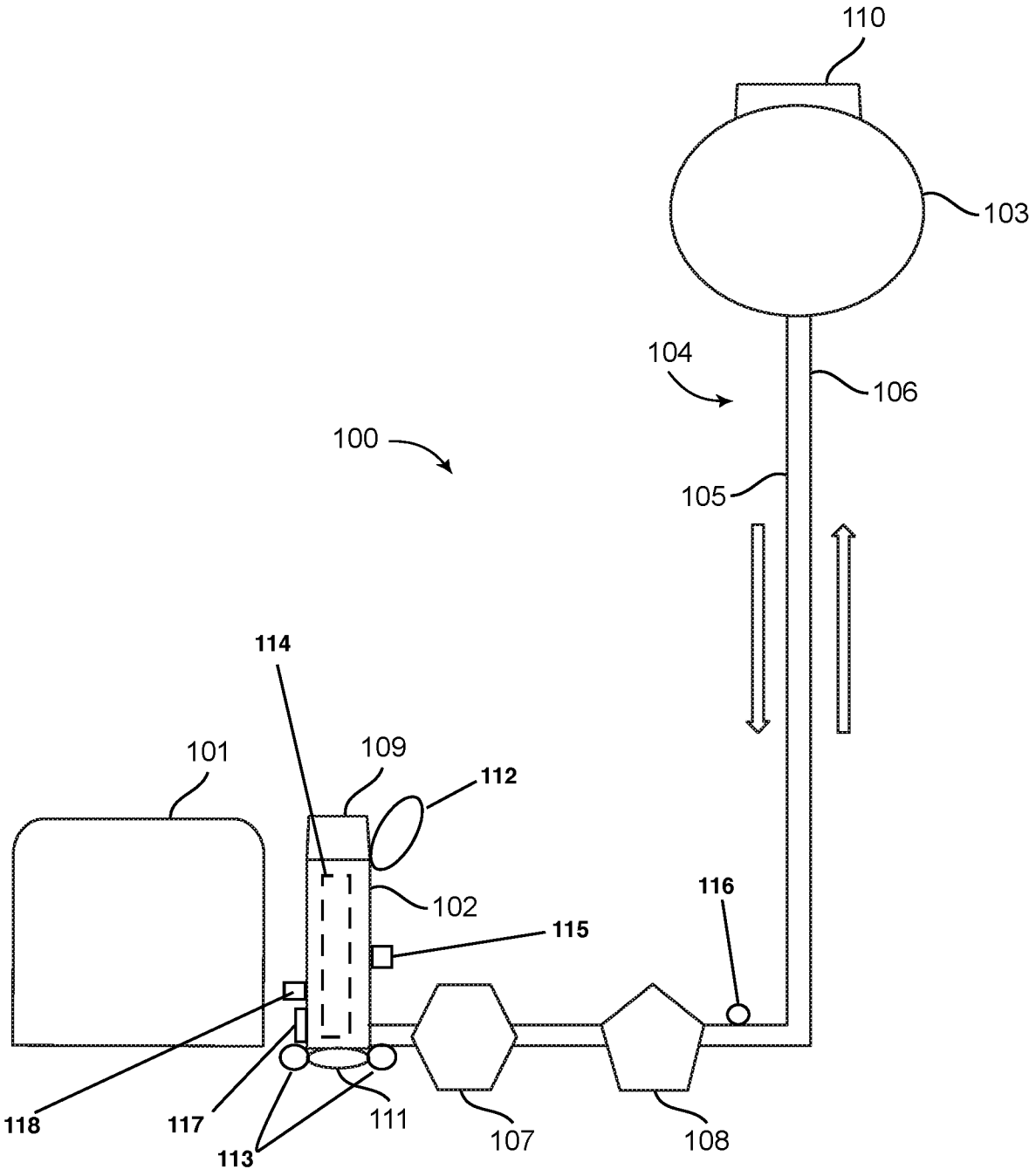
110
103
104
106
100
105
114
101
109
112
102
116
115
118
117
113
111
107
108

HEAT PUMP SYSTEM, COMPONENTS THEREOF AND METHODS OF USING THE SAME

RELATED APPLICATION

This application claims priority to U.S. Provisional Application No. 61/585,095, filed Jan. 10, 2012, hereby incorporated by reference.

BACKGROUND OF THE INVENTION

1. Field of the Invention

The present invention relates generally to conduit heating systems for use with fireplace, wood stoves and other heat sources to transfer heat to remote areas of a home, building or other structure, preferably comprising portable and/or interchangeable components.

2. Description of Related Art

Several publications are referenced in this application. The references describe the state of the art to which this invention pertains and are hereby incorporated by reference, specifically the description of systems and methods and components thereof.

Fireplace and wood stove based conduit heating methods and systems are well documented in the art, of which are included both the water flow and air flow heating systems for the specific purpose of transferring heat generated within the fireplace to a remote location for radiant convection of a surrounding area. The purpose behind such systems generally is to recycle a significant portion of the heat, which is otherwise wasted through the fireplace vent or chimney.

U.S. Pat. No. 5,979,782 relates generally to fireplace or wood stove generated conduit heating systems and, more particularly, to a substantially enclosed fireplace heat transfer system with internally driven heat transfer flow and return fluid flow mechanisms.

U.S. Pat. No. 4,153,199 to Ellmer discloses a fireplace heating system capable of being installed in a conventional fireplace and including a log supporting water conduit grate. The water in the grate is heated by the logs and is then pumped to a suitable heat exchanger disposed within an air duct of a forced air heating system to heat the air passing there through. Heated water may also bypass the heat exchanger and is used to preheat a cold water supply that feeds a hot water heater.

U.S. Pat. No. 4,330,083 to Di Fiore teaches a home heating system in which the heated water is supplied to a water heater or clothes dryer. An arrangement of control valves is utilized to supply heat energy selectively or concurrently to home appliances in a desired combination. At least one expansion tank is located on the heated water outlets from the fireplace and a boiler to accommodate expansion and contraction of the volume of water in the heating system.

U.S. Pat. No. 4,462,542 to Person teaches an auxiliary heating system which also utilizes a conduit for transferring heated air or water from an auxiliary heater, again either a fireplace or wood burning stove, and by means of a pump which provides the heated fluid to a forced air system, hydronic boiler system or hot water heater. A similar example of a pump-driven fireplace heating system is also disclosed in U.S. Pat. No. 4,025,043 to Cleer, Jr. discloses heated water within a fireplace jacket is pumped to a separate water heater and/or radiant heater.

SUMMARY OF THE PRESENT INVENTION

The present invention relates to a heat transfer or heat pump system employing a heat transfer system or means (e.g., circulating fluid, thermally conductive material, etc.) to transfer heat from the heat source (e.g., fireplace, wood stove, exhaust structure, or other heat source) to a remote location of a home, residence, building or other structure. Preferably, the system comprises components that are configured, designed or adapted to be assembled or set up by homeowners without a professional technician and can be easily moved to different locations within a residence, building or other structure. Preferably, the system comprises at least one heat sink for absorbing thermal energy from the heat source, at least one radiator for radiating or conveying heat, and at least one conduit for transferring thermal energy from said heat sink to said radiator.

According to one embodiment of the invention, either the heat sink and/or radiator is portable and preferably includes at least one handle or grip for moving the system from one location to another location. Preferably, the heat sink is not integrated with, attached to, or built or positioned within the heat source (e.g., fireplace), but instead readily installed, re-positioned or moved by individual(s) including homeowners. Accordingly, preferred embodiments of the invention do not require any professional and/or permanent installation but instead may be set up by merely placing the components at the desired locations. For example, locating the heat sink adjacent to or placed on top of the heat source (e.g., a wood stove) and radiator positioned at the remote location desired to be heated (e.g., a different room) and each connected to the other via heat conduits. Preferably, each of the components are designed, configured or adapted to be used while detached from and/or while not integrated with or installed within the heat source (e.g., not within the fireplace but instead adjacent to it).

Preferred embodiments also include kits or packaged products comprising, in one or more containers, including one or more or all of the components of the system. Preferably, including one or more instructions for using the same for setting up and use including safety tips.

According to another embodiment, the system comprises interchangeable components whereby the heat sink, conduit and/or radiator can be readily replaced by replacement components. Preferably, the components can be detached from the system by unscrewing, unlatching or other means. That is, preferably the components (i.e., heat sink, conduit(s) and radiator) can be readily attached and detached and/or assembled/disassembled by individuals.

According to another embodiment, the heat sink includes a system or means (e.g., mechanism to pivot, move or tilt the heat sink or otherwise increase the distance between the heat source and heat sink) to automatically reduce its exposure to the heat source or otherwise reduce or control the temperature of the internal heat transfer fluid.

According to preferred embodiments, the heat sink is connected to multiple heat transfer systems and/or conduit(s) that are in parallel with each other or in series.

According to another embodiment the system includes a sensor or other means to monitor, reduce or control the temperature and/or pressure of the heat transfer fluid and/or conduit(s).

Other aspects as well as embodiments, features and advantages of the present invention will become apparent from a study of the present specification, including the drawings, claims and specific examples.

BRIEF DESCRIPTION OF THE DRAWINGS

Reference will now be made to the attached drawings, when read in combination with the following specification, wherein like reference numerals refer to like parts throughout the several views, and in which:

FIG. 1 is a view illustrating the overall network of the heat sink, radiator and conduit sections forming the heat transfer system according to one embodiment the present invention.

DESCRIPTION OF THE PREFERRED EMBODIMENTS

With reference to FIG. 1, the heat transfer system 100 according to one aspect of the invention includes heat sink 102, which is adjacent heat source 101, radiator 103 and heat transfer conduit component(s) 104 including a first conduit 105 allowing heat transfer to flow from radiator 103 to heat sink 102 and a second conduit 106 allowing heat transfer to flow from heat sink 102 to radiator 103.

Heat transfer system 100 is preferably adapted for use with a conventional fireplace or wood stove, engine, computer servers, or other heat radiating system (e.g., such as heat otherwise typically being wasted through the chimney, vent or the like). Using the invention, heat is captured and transferred to another location.

Preferably, system 100 includes at least one pump 107 for circulating heat transfer fluid through conduits 105 and 106 between heat sink 102 and radiator 103. Pump 107 may be attached or integrated with conduit 104 or integrated with or within heat sink 102 or, preferably, radiator 103. According to another embodiment, the system includes multiple pumps for circulating the heat transfer fluid within the system (e.g., from the heat sink to the radiator and back).

According to preferred embodiments, the system comprises one or more pump mechanisms (e.g., centrifugal or magnetically levitated impeller pump) to pump or circulate the heat transfer fluid through the conduits thus recirculating the fluid through the system. Preferably, the pump is within or attached to the radiator component. Preferably, the pumps do not cavetate.

According to preferred embodiments, the system functions without electricity. According to preferred embodiments, the heat transfer media is a heat transfer material not requiring circulating (e.g., comprises copper, aluminum, steel) and connects to a simple radiator (e.g., comprises copper, aluminum, steel, etc. and configured, adapted or designed to radiate). According to another preferred embodiment, steam generated by the heat source is used to power the system (e.g., power the circulation and/or radiator). According to another preferred embodiment, heat transfer media is circulated using hand cranked pump or similar manpowered mechanism.

Preferably, heat sink 102 includes heat sink adjuster 111 configured to reduce or increase the transfer of thermal energy from heat source 101 to heat sink 102 by tilting or rotating heat sink 102 away from heat source 101 and/or increasing/decreasing the distance between heat source 101 and heat sink 102. More preferably, the system is configured to automatically adjust the heat sink position and/or the radiator output to reduce the temperature and/or pressure. More preferably, the system is also configured to automatically re-adjust the heat sink position and/or the radiator output if the temperature/pressure drops below a desired level.

Preferably, system 100 includes at least one sensor 108 to detect or measure the temperature or pressure within conduit 104. According to one preferred embodiment, if the temperature and/pressure within conduit(s) 105 or 106 increases too much, heat sink adjuster 111 adjusts the position of heat sink 102 to reduce the transfer of thermal energy from heat source 101 to heat sink 102. According to another preferred embodiment, if the temperature and/pressure within conduit 106 increases too much, pump 107 increases the rate of the fluid circulation and/or radiator 103 increases the rate of heat radiating (e.g., the fan blowing air over coils heated by the heat transfer fluid is increased) to reduce the heat load within the conduit. Preferably, the system automatically re-adjusts if the temperature/pressure decreases below a specified level.

Preferably, the system includes one or more color indicators to indicate the temperatures and/or pressures within the heat sink, conduit component(s) and/or radiator. According to another preferred embodiment, the system includes a whistle or other audio device that emits a sound if the temperature and/or pressure within one or more components increases above the desired level.

Heat sink 102 preferably comprises handle or grip 109 or shoulder strap 112 to allow an individual to easily move heat sink 102 to another position, location or into storage. Preferably, handle or grip 109 comprises thermal insulation to protect individuals from excessive heat when moving or touching heat sink 102. Preferably, heat sink 102 comprises wheels or rollers 113 to assist in moving heat sink 102.

Radiator 103 preferably comprises handle or grip 110 (or detachable shoulder straps) to allow an individual to easily move radiator 103 to another position, location or into storage. Preferably, handle or grip 110 comprises thermal insulation to protect individuals from excessive heat when moving or touching radiator 103. Preferably, radiator 103 comprises wheels or rollers (not shown) to assist in moving radiator 103.

Preferably, heat sink 102 and/or radiator 103 are equipped with legs or a stand (not shown) for setting up the component at the desired location.

Preferably, the conduit component is flexible and otherwise designed, configured or adapted to be secured or latched onto, wrapped around or spooled on or within either the heat sink 102 or radiator 103 (or both) to facilitate carrying the system and/or storing. For example, after use, the individual can detach the conduits and spool around a portion of either component. Preferably, the heat sink and radiator can be attached to each other using latches, clips, or other systems or means for releasably attaching the components to facilitate carrying and/or storage.

Preferably, heat sink 102 comprises at least a first side that is adapted to be exposed to the heat source (i.e., adapted to absorb thermal energy or heat) and a second side with thermal insulation to contain the thermal energy absorbed by the heat sink and/or protect individuals from contacting the heated heat sink by providing a protective layer. For example, one side of the heat sink may be an exposed black anodized aluminum surface for absorbing thermal energy while on or more other surfaces comprise an insulation layer or surface.

Preferably, radiator 103 includes a pedestal or stand that allows the direction of the heat being radiated to be changed, altered, re-directed or otherwise adjusted. Preferably, the radiator can automatically change the direction of the emitted radiation (e.g., a rotating fan).

According to preferred embodiments, conduit 104 and/or conduits 105 and 106 are easily attachable and detachable to heat sink 102 and/or radiator 103. Preferably, attached via screwing, clamping, or some other quick connect system using an interference or interfitting fit to an end of the conduit onto an outlet of heat sink 102 or radiator 103.

Preferred embodiments of the invention do not require professional installation but instead may be set up by merely placing or positioning the components at the desired locations (e.g., heat sink adjacent the heat source and radiator at the remote location desired to be heated) and connecting or otherwise assembling to form the heat transfer system according to the invention. Preferred embodiments also include kits comprising, in one or more containers, including one or more or all of the components of the system.

According to another embodiment, the system comprises interchangeable components whereby the heat sink, conduit and/or radiator can be readily replaced. Preferably, the component can be detached from the system by unscrewing, unlatching or other systems or means. Preferably, the system is configured so an individual can easily detach the conduit(s) from the other components. Preferably, the conduit(s) can be replaced by one with different lengths or other specifications to accommodate a more remote location for the radiator.

According to one preferred embodiment, the system comprises at least one branch conduit or additional conduit leading to a second radiator. Preferably, additional branch conduits can be added in series or parallel to the conduit to accommodate additional radiators (e.g., for use in additional spaces or locations).

Another embodiment of the invention relates to a heat transfer system for transferring thermal energy from a heat source to a heat radiator comprising:

(a) a heat sink adapted to receive thermal energy from a heat source;

(b) a heat radiator adapted to radiate heat; and (c) a thermal conduit for transferring heat from said heat sink to said heat radiator, wherein said heat sink or said heat radiator are configured to be portable so that individuals can move either or both components to different locations within a home, building or other structure.

Preferably, the heat radiator is remote from the heat sink (e.g., connected via the thermal conduit), preferably at least five feet, more preferably at least ten feet, even more preferably at least twenty feet away from the heat sink. For example, preferably the heat radiator radiates the heat transferred to a different room.

Preferably, the energy or source is a stove or fireplace (e.g., wood, gas or pellet), computer(s) or server(s), engine or machine, manufacturing facility, boiler, oven or other heat source. For example, the heat sink can be placed adjacent a computer server or combustion engine generating excess heat and transfer the heat generated to another room or to the outside the facility.

According to another aspect of the invention, the radiator is replaced with one or more electrical generators, motors, energy storage devices, or fan(s) powered by the heated fluid.

Preferably, the heat sink comprises an inlet for receiving a heat transfer liquid and an outlet for emitting said heat transfer liquid.

Preferably, the heat sink is a metallic block having passages 114 therein for internally flowing said heat transfer liquid.

Preferably, the heat sink comprises an internal passage for flowing said heat transfer liquid therein thereby transferring thermal energy from said heat sink to said heat transfer liquid.

Preferably, the heat sink is a metallic block, more preferably aluminum or graphite block. According to another embodiment, the heat sink is a graphite block.

According to a preferred embodiment, the heat sink is an aluminum block with channels drilled through it at varying angles to form passages and, preferably, external openings plugged or sealed except for an outlet for heated fluid and an inlet for the return fluid. Alternatively, the heat sink may comprise any heat conductive material (e.g., steel, graphite, etc.).

According to preferred embodiments of the invention, the heat sink comprises at least one handle or grip for easily moving said heat sink. Preferably, the handle or grip includes thermal insulation to protect the user from excessive heat exposure when handling.

According to another preferred embodiment, the heat sink comprises wheels or rollers for easily moving the heat sink. For example, if the heat sink is metallic and/or had at least two dimensions greater than 12 inches (preferably greater than 20 inches), the wheels or rollers to facilitate moving the component.

According to another preferred embodiment, the heat sink comprises a thermometer 115 displaying or indicating the temperature of said heat sink, said heat transfer fluid or both.

According to another preferred embodiment, further comprising at least one pressure release valve 116 configured to reduce the pressure within the conduit component(s). Preferably, the pressure release valve 116 is attached to the conduit, the heat sink and/or radiator.

Preferably, the heat sink is not permanently situated or positioned within the fireplace, even more preferably not even temporarily situated or positioned within the fireplace when in use. Instead, the heat sink is preferably configured, designed or adapted to be placed or positioned adjacent the heat source or other positioned closed yet detached from the heat source. According to other preferred embodiments, the heat sink may rest on the heat source (e.g., wood stove).

Preferably, the heat sink is not in contact with the heat source, more preferably not in contact with the burning fuel (e.g., burning wood). According to preferred embodiments, the heat sink does not come into direct contact with smoke or other emissions from the heat source (except for thermal energy). Preferably, the heat sink is adapted, designed or configured to be used and stored without having to be cleaned. For example, wood grate systems require installation before starting the fire and become covered with ash and soot after use and thus typically require cleaning before off-season storage, removal, transportation, or non-use.

According to one embodiment, the system comprises at least one mechanical pump sufficient to move the heat transfer media through the conduit(s) at varying speeds (preferably without creating excessive cavitation in the fluid). Preferably, the pump is connected in line with the heat sink, conduit and radiator. For example, a typical centrifugal pump would work well whereas a diaphragm pump may create excessive vibration and cavitation. Accordingly, preferred systems including one or more centrifugal or other pump not likely to create excessive cavitation when used.

According to another preferred embodiment, a magnetically levitated impeller mechanism is used to move fluid to reduce the chance of mechanical failure whether by breached seal or via moving mechanical parts.

Preferably the impeller mechanism contains an impeller within the conduit and an accessory that sits adjacent to the conduit whereby the accessory supplies the appropriate energy and forces through the conduit walls to the impeller to force its rotation and subsequent movement of fluid.

In another preferred embodiment, the accessory can also supply varying amounts of force to the impeller to increase or decrease fluid flow through the impeller.

Another preferred embodiment of the invention further permits feedback from any sensing elements in the system (e.g., temperature or pressure) that can increase or decrease fluid flow via the impeller via the accessory.

According to preferred embodiments, the pump is included within or integrated with one of the components, preferably the radiator, to advantageously reduce the number of components to the system.

According to another preferred embodiment, the heat sink comprises a heat sensing mechanism or heat sensor system 117 that is adapted, designed and/or configured to increase or decrease the average distance of a surface of the heat sink to the heat source (e.g., by rocking the heat sink towards or away from the heat source and/or rotating it's surface away from the heat source).

Preferably, the heat sensing mechanism increases the distance between the heat sink and heat source if the fluid temperature is above a designated temperature.

According to another preferred embodiment, the heat sensing mechanism rocks or tilts or rotates the heat sink away from said energy source. Preferably, this is achieved by an inverted pyramidal (the pointed nature ensures that these elements are not primary heat conductors) component or other structure that expands upon heating above a designated temperature.

According to another preferred embodiment, the heat sink comprises a rounded bottom that allows the heat sink to rock towards and away from said energy source.

According to another preferred embodiment, the heat sink comprises a mechanism proximate said rounded bottom for rocking said heat sink away from said energy source.

According to another preferred embodiment, the heat source comprises at least one spring 118 to push said heat sink away from said energy source. Preferably, a spring expands or contracts when heated or cooled.

According to another preferred embodiment, the system further comprises at least one heat sensor or pressure detector for detecting the temperature or pressure of the fluid or heat transfer material or other components within said system. Preferably, the detectors may have a mechanism for feeding back the information to other control elements within the system for increasing or decreasing heat transfer.

According to another preferred embodiment, the system comprises a mechanism to increase the distance between said heat sink and said energy source if said temperature is too high. Preferably, the mechanism pivots the heat sink to reduce its exposure to the energy source.

According to another preferred embodiment, the mechanism employs at least one spring to increase said distance. Preferably, the spring expands when heated above a certain temperature causing the heat sink to rotate, tilt or otherwise move relative to the heat source.

According to one embodiment, the thermal conduit comprising a two-way thermally insulated hose comprising a first conduit for transferring a heat transfer liquid from said heat sink to said heat radiator in thermal isolation from a second conduit for transferring said heat transfer liquid from said heat radiator to said heat sink. According to alternative embodiment, the conduit(s) comprise thermally conductive materials rather than a fluid.

According to one preferred embodiment, the thermal conduit comprises at least one temperature sensor.

According to another preferred embodiment, the thermal conduit comprises at least one pressure sensor.

According to another preferred embodiment, the thermal conduit comprises at least one pressure release valve.

Preferably, the thermal conduit is surrounded by insulation.

According to another preferred embodiment, the thermal conduit comprises at least one pump for recirculating said heat transfer liquid.

According to another preferred embodiment, the thermal conduit is connected to at least one pump for circulating said heat transfer liquid to/from said heat sink and radiator.

Preferably, the conduit(s) are adapted or configured to be threaded or snaked through existing ductwork. That is, for example, the heat sink can be positioned in a room with a wood stove and thermally connected or attached to the conduit component, which is snaked via ducts to another room to thermally attach or connect to the radiator.

Preferably, the conduits are flexible (e.g., capable of being spooled and unspooled repeatedly) and are not rigid or permanently installed.

Preferably, the conduit(s) have a length greater than 2 feet, preferably greater than 4 feet, even more preferably greater than 8 feet, even more preferably greater than 15 feet and most preferred greater than 20 feet.

According to one aspect of the invention, the conduit(s) according to the invention, transfers thermal energy from the heat source to the radiator(s). According to one preferred embodiment, the conduit(s) comprise or are adapted or configured to be filled with or are filled with a thermally conductive fluid. Preferably, the conduit comprises a heat transfer material, media, gas, or fluid, preferably having a thermal conductivity equal or greater than 0.6 W/(m·K) ("k"), more preferably greater than 0.7 k, even more preferably greater than 1 k, even more preferably greater than 5 k and more preferred greater than 10 k. Preferably, the heat transfer media is non-toxic, non-corrosive and, more preferably, also "green" (i.e., environmentally friendly). Preferably, the heat transfer media also has a low viscosity.

Preferably, the conduit(s) contain a heat transfer fluid comprising water. More preferably, the fluid comprises ethylene glycol, even more preferably a mixture of water and ethylene glycol which has both a high heat capacity and low viscosity.

Another embodiment relates to a heat transfer system for use with a heat generating medium for radiating heat at a remote location from the fireplace, said heat transfer system including a network of interconnecting conduit sections charged with an internal fluid medium or comprising a heat transfer material and comprising:

at least one heat sink of said conduit being located proximate the heat (e.g., fireplace) generating medium so that said fluid medium is subject to heat generated within the medium; and a radiator arrayed or located at a remote location and in fluid communication with an outlet of said heat sink, said radiator receiving there through a flow of said heated fluid medium so as to convect heat therefrom to a surrounding environment, wherein said heat sink or said radiator are configured or adapted to be portable so that individuals can move either or both components to different locations within a home, building or other structure.

Another embodiment relates to a heat transfer system for use with a fire or heat generating medium for radiating heat at a remote location (e.g., from the fireplace). Preferably, the heat transfer system includes a network of interconnecting conduit sections charged with an internal fluid medium and comprising:

at least one heat sink being located proximate the fire or heat generating medium so that said fluid medium is subject to heat generated from the medium;

a first valve connected to at least one conduit and actuating from a closed position to an open position in response to a first selected fluid pressure being achieved within said heated fluid medium, a steam inversion tube in fluid communication with said conduit and an inlet of said first pressure actuated valve, said inversion tube including an outer coaxial chamber and an inner coaxial chamber which entraps superheated steam generated by said internal fluid medium within said conduit;

a radiator arrayed at a remote location and in fluid communication with an outlet of said first valve, said radiator receiving there through a flow of said heated fluid medium so as to convect heat therefrom to a surrounding environment;

a second valve located on an outlet side of said radiator and actuating from a closed position to an open position in response to said flow of said internal fluid medium at substantially said first selected water pressure;

an expansion tank in fluid communication with an outlet of said second valve, said expansion tank beginning to fill with said internal fluid medium in response to said flow of said medium through said second valve;

a third pressure sensitive valve in communication with an outlet of said expansion tank and responsive on an inlet side to a second higher selected fluid pressure achieved within said expansion tank to actuate from a closed to an open position to permit said flow of fluid medium there through, said first and second valves actuating to said closed position prior to said opening of said third valve;

said steam inversion tube in fluid communication with an outlet of said third pressure sensitive valve and, responsive to passage of said fluid medium through said outer coaxial chamber, preheating said fluid medium concurrent with saturating said superheated steam; and said preheated fluid medium communicating with an inlet of said at least one fireplace conduit and said third valve actuating to said closed position in response to a decrease in said outlet fluid pressure below said second selected fluid pressure.

For example, the system components and embodiments described in U.S. Pat. No. 5,979,782 to Elwart, hereby incorporated by reference.

Preferably, the system further comprises a bleed valve located along said conduit network between said first valve and said radiant convection device, said bleed valve removing air remaining within said heated fluid medium.

Preferably, the system further comprises a relief valve located along said conduit network between said bleed valve and said radiant convection device, said relief valve actuating from a closed position to an open position in response to said fluid medium achieving a third selected fluid pressure higher than said first and second fluid pressures.

Preferably, the system further comprises a temperature and pressure gauge located along said conduit network between said bleed valve and said radiant convection device.

Preferably, the system further comprises a make-up water unit located along said conduit network between said second pressure actuated valve and said expansion tank.

Preferably, the radiant convection device further comprises a baseboard radiant heater.

Preferably, the radiant convection device further comprises an under floor radiant heater.

Preferably, the expansion tank further comprises an elastic and resilient bladder separating an interior of said tank into an upper volume and a lower volume, said upper volume in communication with an inlet of said tank from said conduit network, said bladder downwardly and outwardly actuating across said lower volume in response to filling of said tank with said internal fluid medium.

Preferably, the internal fluid medium comprises water, said first pressure sensitive valve actuating to said open position upon said first selected fluid pressure preferably equaling 8 pounds of water pressure existing on said inlet side of said first valve.

Another aspect of the invention relates to a heat transfer system comprising:

(a) insulated lines for carrying heated fluid;
(b) a heat transfer block capable for transferring thermal energy from a heat source to said fluid;
(c) a recirculating pump to move the heat transfer fluid around the insulated lines; and
(d) thermal radiating element, preferably comprising a fan, more preferably a fan blowing over a coil (preferably copper coil) holding the recirculated heat transfer liquid.

Preferably, the system further comprises at least one mechanism for managing how much heat can be absorbed by the system to prevent formation of super heated water or liquid, e.g., maintain the water to below boiling. Preferably, a simple additional element or configuration such as placing the heat transfer block on pins so that, as they heat more, they expand more and thereby push the block further from the heat source. Similarly, in other embodiments, a feedback loop could be used to increase the recirculating pump throughput and/or the radiator fan rpm can be increased so as to remove heat from the heat transfer liquid more rapidly.

According to one embodiment the system includes an internally driven fluid flow mechanism for flowing the fluid from the heat source to a heat radiator device and back for reheating. Preferably, heated fluid is recirculated through the radiator and returned to the heat sink proximate the fireplace for subsequent reheating. The heat transfer system includes a network of interconnecting conduit sections charged with an internal fluid medium, in the preferred embodiment that being a quantity of water and more preferably further containing ethylene glycol.

Preferably, a first valve is located at an outlet of the heat sink and actuates from a closed position to an open position in response to a first selected fluid pressure being achieved within the heated fluid medium. A steam inversion tube is located in fluid communication with the outlet of the fireplace coils and an inlet of the first valve and includes an outer coaxial chamber and an inner coaxial chamber capable of entrapping superheated steam generated by the heated fluid medium.

A further length of conduit section connects a radiant convection device arrayed at a remote location with the outlet of the first valve on a "hot" side and receives there through a flow of the heated fluid medium so as to convect heat therefrom to a surrounding environment. The radiant convection device according to the preferred embodiments is in the form of either baseboard or under floor radiant systems with an appropriate heated medium temperature of either 180 degrees or 120 degrees, respectively.

A second valve is preferably spaced from the radiant convection device on a "cool" side of the convection device by a further length of conduit and, similarly to the first valve, opens in response to flow of the internal fluid at substantially the first selected fluid pressure. An expansion tank is located in fluid communication with an outlet of the second valve and begins to fill with the fluid medium in response to the flow of the fluid through the second valve. The expansion tank in the preferred embodiment includes an elastic and resilient bladder separating an interior of the tank into an upper volume and a lower volume, the upper volume communication with an inlet from the conduit network.

Upon a selected higher fluid pressure being established within the expansion tank, the second valve is closed and a third valve located on an outlet side of the tank is forced open so that the cooled fluid medium passes there through. The steam inversion tube previously described is connected to an outlet of the third valve and functions to both pre-heat the cooled water prior to delivering it to an inlet of the fireplace coils as well as saturating the superheated steam contained within the inner coaxial chamber of the inversion tube. Upon completion of the cycle, the valves are all closed and the fireplace begins to reheat the specified volume of internally charged fluid medium held within the coils for a subsequent cycle.

Additional features of the present invention include the provision of a bleed valve, relief valve and pressure/temperature gauge located on the "hot" side connection between the first valve and the radiant convection device. A make-up water unit is also located between the second valve and the expansion tank and enables additional volumes of water to be recharged into the enclosed system in the rare instances that such is required. Further, the first and second valves are preferably gravity fed valves which open and close in response to water pressure disparities on the inlet and outlet sides thereof.

Preferably, the heat transfer system includes a plurality of coils of conduit, which are interconnected and wound consecutively.

Preferably, the thermal energy from the heat source causes the temperature of the fluid medium/water within the conduit(s) to a selected overall temperature (e.g., 120 degrees Fahrenheit for use with an under floor radiant heater, or 180 degrees Fahrenheit for use with a baseboard heater). Subsequent heating may cause some of the water to convert to superheated steam, which may be entrapped within a inner coaxial chamber of a steam inversion tube 30. For example, see the system(s) described in the figures and details of the invention of U.S. Pat. No. 5,979,782, hereby incorporated by reference.

Another aspect of the invention relates to methods of using the above-described systems comprising, in one or more steps: (i) placing or positioning the heat sink adjacent the heat source; and (ii) placing or positioning the radiator in the desired location.

Preferably, the method further comprises attaching or connecting the conduit component(s) to the heat sink and to the radiator.

Preferably the method further comprises filling the conduit components with fluid.

Preferably, the method further comprises re-positioning the heat sink and/or increasing the radiation emitted to reduce the temperature and/or pressure within the system, preferably after a signal or other indication that the temperature and/or pressure are too high.

Preferably, the method further comprises replacing or replenishing the fluid within the conduit.

Having described the invention, additional embodiments will become apparent to those skilled in the art to which it pertains. Specifically, the heat source can include any one of a number of different mediums/components, such as a water heater, machinery, computer system, engine, manufacturing facility, boiler or even hot tub or Jacuzzi. Also, the input and output temperatures of the heat sink, radiator and/or heat transfer fluid can be set at any different value as is desired for optimal performance and/or safety of a given application.

While the particular methods, devices and systems described herein and described in detail are fully capable of attaining the above-described objects and advantages of the invention, it is to be understood that these are the presently preferred embodiments of the invention and are thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular means "one or more" and not "one and only one", unless otherwise so recited in the claim.

It will be appreciated that modifications and variations of the invention are covered by the above teachings and within the purview of the appended claims without departing from the spirit and intended scope of the invention. For example, the means or structures or methods of controlling or reducing the temperature of the heat transfer fluid may comprise several discrete modules that together still provide the same functionality and/or may encompass combined steps or several intermediate steps that do not detract from the higher level functionality described therein.

The invention claimed is:

1. A portable heat transfer system for transferring thermal energy from a heat source to a heat radiator, said portable heat transfer system comprising:

(a) a portable heat sink adapted to receive thermal energy from said heat source, wherein said portable heat sink is adapted to be placed adjacent to or placed on top of said heat source;

(b) a portable heat radiator adapted to radiate heat; and (c) a portable thermal conduit for transferring heat from said portable heat sink to said portable heat radiator, wherein said portable heat sink or said portable heat radiator are portable so that individuals can move either or both components to different locations within a home, building or other structure and wherein said portable thermal conduit is flexible and wherein said portable heat sink is not attached to, or built or positioned within said heat source, wherein said portable thermal conduit has a length greater than 4 feet and said portable heat sink comprises one or more surfaces comprising an insulation layer, and (i) wherein said portable heat sink comprises at least one handle or grip for moving said portable heat sink, or (ii) wherein said portable heat sink comprises wheels or rollers for moving said portable heat sink, or (iii) wherein said portable heat sink comprises combination of (i) and (ii).

2. The heat transfer system of claim 1, wherein said heat source is a wood stove or fireplace and wherein said portable heat transfer system does not comprise said heat source and said portable heat transfer system is adapted for use with said wood stove or said fireplace.

3. The heat transfer system of claim 1, wherein said portable heat sink comprises an inlet for receiving a heat transfer liquid and an outlet for emitting said heat transfer liquid and said portable thermal conduit is adapted to be spooled.

4. The heat transfer system of claim 1, wherein said portable heat sink is a metallic block having passages therein for internally flowing said heat transfer liquid and said heat transfer liquid comprises water and ethylene glycol.

5. The heat transfer system of claim 1, wherein said portable heat sink comprises an internal passage for flowing said heat transfer liquid therein thereby transferring thermal energy from said portable heat sink to said heat transfer liquid.

6. The heat transfer system of claim 1, wherein said portable heat sink is a structure made of or from a material having a heat transfer coefficient greater than 7.9 W/m2K.

7. The heat transfer system of claim 1, wherein said portable heat sink is an aluminum or graphite block.

8. The heat transfer system of claim 1, wherein said portable heat sink comprises said at least one handle, or grip for moving said portable heat sink.

9. The heat transfer system of claim 1, wherein said portable heat sink comprises said wheels or rollers for moving said portable heat sink.

10. The heat transfer system of claim 1, wherein said portable heat sink comprises a thermometer displaying or indicating the temperature of said portable heat sink, said heat transfer fluid or both.

11. The heat transfer system of claim 1, further comprising a pressure release valve.

12. The heat transfer system of claim 1, wherein said portable heat sink comprises a heat sensing mechanism adapted to increase or decrease the average distance of a surface of the portable heat sink to the heat source.

13. The heat transfer system of claim 12, wherein said heat sensing mechanism is adapted to increase the distance between the portable heat sink and heat source if the fluid temperature is above a designated temperature.

14. The heat transfer system of claim 12, wherein said heat sensing mechanism is adapted to rock or tilt the portable heat sink away from said heat source.

15. The heat transfer system of claim 1, wherein said portable heat sink comprises a rounded bottom that allows the portable heat sink to rock towards and away from said heat source.

16. The heat transfer system of claim 1, wherein said heat sink comprises at least one spring to push said portable heat sink away from said heat source.

17. The heat transfer system of claim 1, wherein said system further comprises at least one heat sensor for detecting the temperature of the fluid within said system.

18. The heat transfer system of claim 17, wherein said system comprises a mechanism to increase the distance between said portable heat sink and said heat source if said temperature is too high.

19. A portable heat transfer system comprising:

(a) insulated lines configured for carrying heated fluid;

(b) a portable heat transfer block capable of transferring thermal energy from a heat source to said heated fluid;

(c) a recirculating pump to move the heat transfer fluid around a circuit formed by said insulated lines; and (d) a thermal radiating element, wherein said portable heat transfer block is not attached to, or built or positioned within said heat source and said insulated lines have a length greater than 8 feet and wherein said portable heat transfer system is adapted for use with a fireplace, wood stove, engine, machine, computer or server.

20. A method of using the portable heat transfer system of claim 1, comprising:

(i) positioning the portable heat sink adjacent said heat source;

(ii) positioning the portable heat radiator in a desired location; and (iii) filling the portable thermal conduit with a fluid, wherein said fluid comprises water.

21. The portable heat transfer system of claim 1, wherein said portable thermal conduit is adapted to transfer a heat transfer fluid comprising water.

22. A portable heat transfer system for transferring thermal energy from a heat source to a heat radiator comprising:

(a) a portable heat sink adapted to receive thermal energy from said heat source;

(b) a portable heat radiator adapted to radiate heat; and (c) a portable thermally insulated two-way conduit for transferring heat from said heat sink to said heat radiator, wherein said portable heat sink comprises a metallic block placed adjacent to or placed on top of the heat source but not attached to or built or positioned within the heat source and said portable thermally insulated two-way conduit comprises a first conduit for transferring heat transfer fluid from said portable heat sink to said portable heat radiator and a second conduit for transferring heat transfer fluid from said portable heat radiator to said portable heat sink and wherein said portable heat radiator comprises a fan.

23. A kit comprising, in one or more containers, components of portable heat transfer system of claim 1 including said portable heat sink, said portable heat radiator, and said portable thermal conduit.

24. The heat transfer system of claim 1, wherein said heat source is a wood stove, fireplace, engine, machine, exhaust, computer, server, or manufacturing facility.

25. The heat transfer system of claim 1, wherein said portable heat sink has a first side adapted to absorb thermal energy and a second side with thermal insulation.

26. The portable heat transfer system of claim 19, wherein said portable heat transfer block further comprises a handle or grip comprising thermal insulation.

27. The portable heat transfer system of claim 19, wherein said recirculating pump is a centrifugal pump or magnetically levitated impeller pump.

* * * * *